US006056049A

United States Patent [19]

Davis

[11] Patent Number: 6,056,049

[45] Date of Patent: May 2, 2000

[54] WELLHEAD RETRIEVING TOOL

[75] Inventor: John P. Davis, Cypress, Tex.

[73] Assignee: Baker Hughes Incorporated, Houston, Tex.

[21] Appl. No.: 09/053,341

[22] Filed: Apr. 1, 1998

[51] Int. Cl.[7] ..... E21B 29/00

[52] U.S. Cl. ..... 166/55.7; 166/98; 166/361

[58] Field of Search ..... 166/361, 55.7, 166/55.8, 298, 98

[56] References Cited

U.S. PATENT DOCUMENTS

| | | | |
|---|---|---|---|
| 1,155,926 | 10/1915 | Jack | 294/86.2 |
| 2,203,011 | 6/1940 | Ellis et al. | 166/55.7 |
| 2,261,564 | 11/1941 | Robichaux et al. | 166/55.7 |
| 3,265,431 | 8/1966 | Burner | 294/86.25 |
| 3,301,324 | 1/1967 | Smith | 166/355 |
| 3,983,936 | 10/1976 | Kennard et al. | 166/55.8 |
| 4,191,255 | 3/1980 | Rives | 166/297 |
| 4,550,781 | 11/1985 | Kagler, Jr. | 166/340 |
| 4,703,802 | 11/1987 | Bryan et al. | 166/298 |
| 4,969,514 | 11/1990 | Morris et al. | 166/55 |
| 5,145,228 | 9/1992 | Boyle | 294/86.25 |
| 5,318,115 | 6/1994 | Rouse | 166/55.7 |
| 5,580,114 | 12/1996 | Palmer | 294/86.15 |

FOREIGN PATENT DOCUMENTS

471588A1 2/1992 European Pat. Off. .

*Primary Examiner*—Hoang Dang
*Attorney, Agent, or Firm*—Duane, Morris & Heckscher LLP

[57] ABSTRACT

A wellhead retrieval tool is disclosed which is adaptable to a variety of configurations of wellheads. The tool comprises a spear through which a rotary cutter can operate. The tool can be adjustably supported off the top of the wellhead so that the grappling mechanism can be located at the proper distance for a grip on an inward upset or restriction within the wellhead. The clutching mechanism is located outside of the wellhead so as not to contaminate it with cuttings returned with the circulating fluid. The seal bore in the wellhead is protected by the tool to avoid damage. The dogs which engage the internal inward upset or restriction further have wickers or serrations on them to enhance the grip and to resist applied torque.

19 Claims, 4 Drawing Sheets

WELLHEAD RETRIEVING TOOL

FIELD OF THE INVENTION

The field of this invention relates to tools that facilitate cutting casing while applying a tensile load to the casing through a wellhead and ultimately recovering the wellhead.

BACKGROUND OF THE INVENTION

Situations arise where a well is to be abandoned and the wellhead is to be recovered. In other circumstances, the casing needs to be cut and it is desirable to perform the cut while the casing is in tension. In situations where the casing is to be cut below the wellhead, various tools have been employed in the past to allow application of a tensile force to the casing, while a cutter rotates to cut the casing. Generally speaking, these tools have taken a grip within the seal bore area of the wellhead by attempting to engage grooves or threads adjacent the internal seal bore of the wellhead. These devices have proven to be potentially troublesome if the engagement with the internal groove or thread is not accomplished properly. As a result, the cutter can spin, within the wellhead, and disengage the connection to the wellhead which provides the tensile load on the casing all during the cutting operation.

Another problem encountered with previous devices is the large assortment of dimensional relationships in wellheads. Thus, for prior designs, involving a spear to be used to apply the tensile load to the casing, the distance from where the portion of the spear stops its movement to where the gripping member is positioned at that time, might need to be altered depending on the particular wellhead. As a result, in the past, specific tools were required for specific geometrical relationships. One of the objects of the present invention is to provide a multi-purpose tool which can accommodate different dimensional relationships in wellheads so as to accomplish a cutting of the casing while under an overpull regardless of the internal wellhead configurations.

Clutching mechanisms have been used for facilitation of the grip of the spear holding the rotary cutter and for its ultimate release. However, prior designs have allowed the clutching assembly to be located within the wellhead while the cutting operation proceeds. The disadvantage of such a configuration was that when the cuttings are circulated out of the wellhead, they tend to lodge in the clutching mechanism if the clutching mechanism is still in the return fluid stream. Thereafter, disengagement of the device from the wellhead becomes problematic as the clutch mechanism fails due to clogging or plugging with casing cuttings.

Certain prior designs illustrating some of the shortcomings mentioned above are illustrated in U.S. Pat. No. 4,969,514 as well as a product called 2M Rotating Spear offered by Red Baron Oil Tools Rental of Aberdeen, UK as well as the model 2M Cut and Pull System offered by the same company. A wellhead cut and pull spear offered by Baker Oil Tools under product number 122-14 also employs the concept of gripping the internal grooves or threads in a wellhead. Another similar tool is offered by HOMCO and is known as Subsea Wellhead Cutoff and Recovery (SCOR). This tool also grips internally to grooves or threads within the wellhead.

It is thus an object of the present invention to provide a wellhead retrieval tool which is adaptable to any configuration of the wellhead. It is also an object of the present invention to protect the seal bore of the wellhead while the casing cutting operation proceeds. Another object of the present invention is to locate the clutch mechanism outside the flow path of the circulating fluid which brings cuttings out of the wellhead, so as to enhance the reliability of the clutching mechanism. These and other advantages of the present invention will be more readily understood by those skilled in the art from the description of the preferred embodiment below.

SUMMARY OF THE INVENTION

A wellhead retrieval tool is disclosed which is adaptable to a variety of configurations of wellheads. The tool comprises a spear through which a rotary cutter can operate. The tool can be adjustably supported off the top of the wellhead so that the grappling mechanism can be located at the proper distance for a grip on an inward upset or restriction within the wellhead. The clutching mechanism is located outside of the wellhead so as not to contaminate it with cuttings returned with the circulating fluid. The seal bore in the wellhead is protected by the tool to avoid damage. The dogs which engage the internal inward upset or restriction further have wickers or serrations on them to enhance the grip and to resist applied torque.

DETAILED DESCRIPTION OF THE PREFERRED EMBODIMENT

Figure 1:
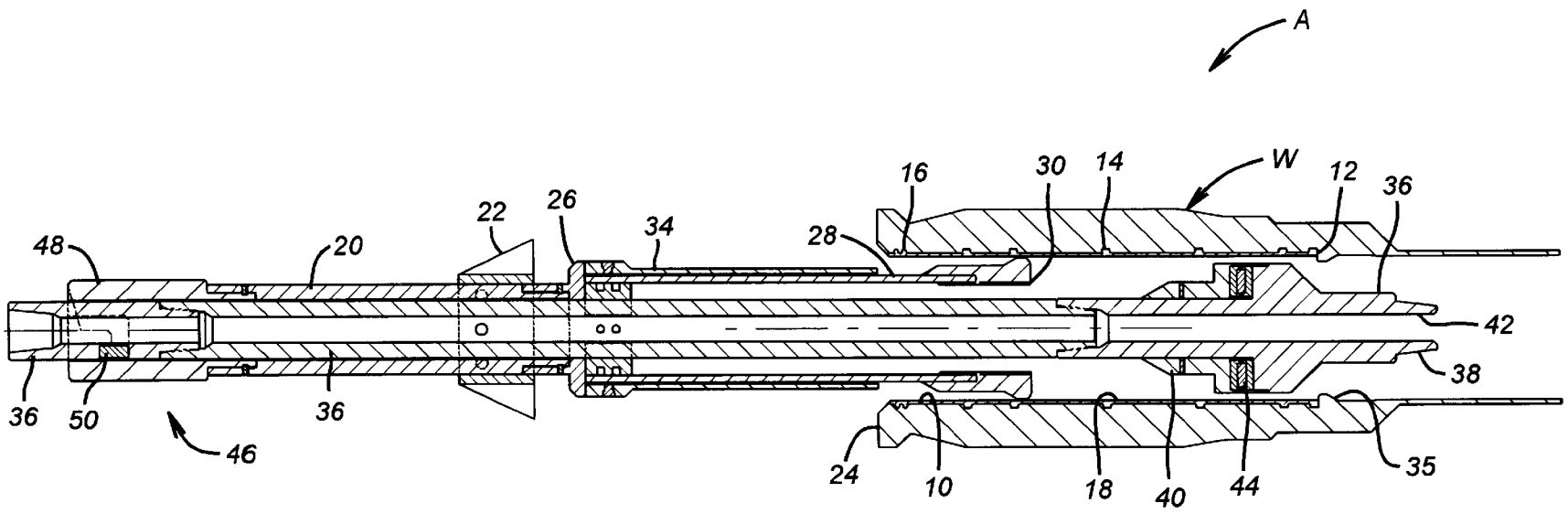
FIG. 1 is a sectional elevational view showing the tool being inserted into the wellhead.

The apparatus A is shown in a run-in mode in FIG. 1. A wellhead W has a seal bore 10 and an internal shoulder 12. The seal bore 10 has one or more grooves 14 to facilitate sealing to a tubing string, such as when the wellhead is used in Subsea applications. The seal bore 10 also has an internal thread such as 16 which has also been used in the past to engage retrieving tools. Before inserting the apparatus A into the wellhead W, a wear bushing 18 is installed and secured in the seal bore 10. The wear bushing 18 protects the seal bore 10 during insertion and removal of the apparatus A. The internal shoulder 12 supports the wear bushing in its position as illustrated in FIG. 1.

Figure 3:
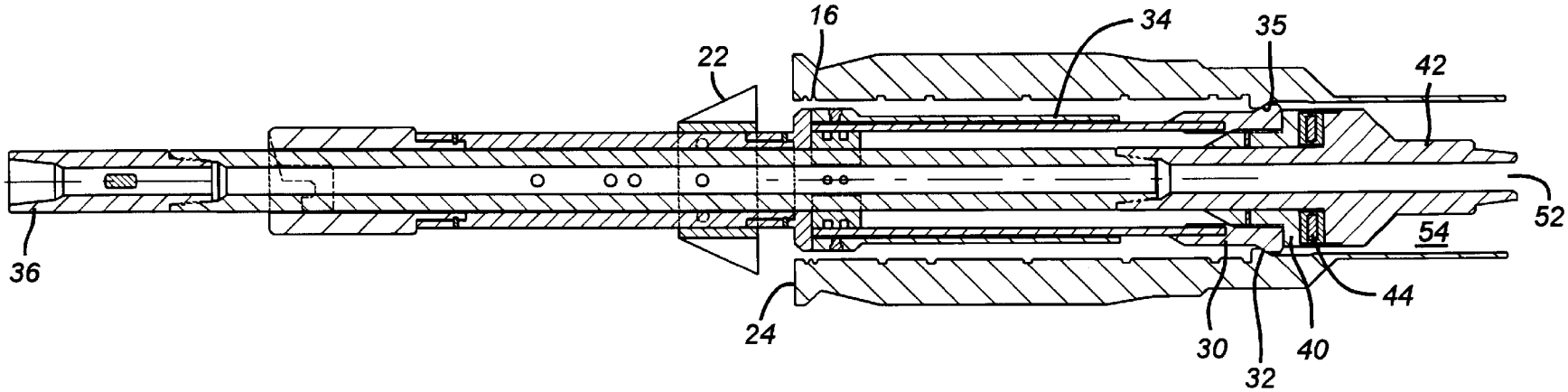
FIG. 3 is the view of FIG. 2, showing the result of a pickup force which lands the latching lug against the internal restriction.
Figure 4:
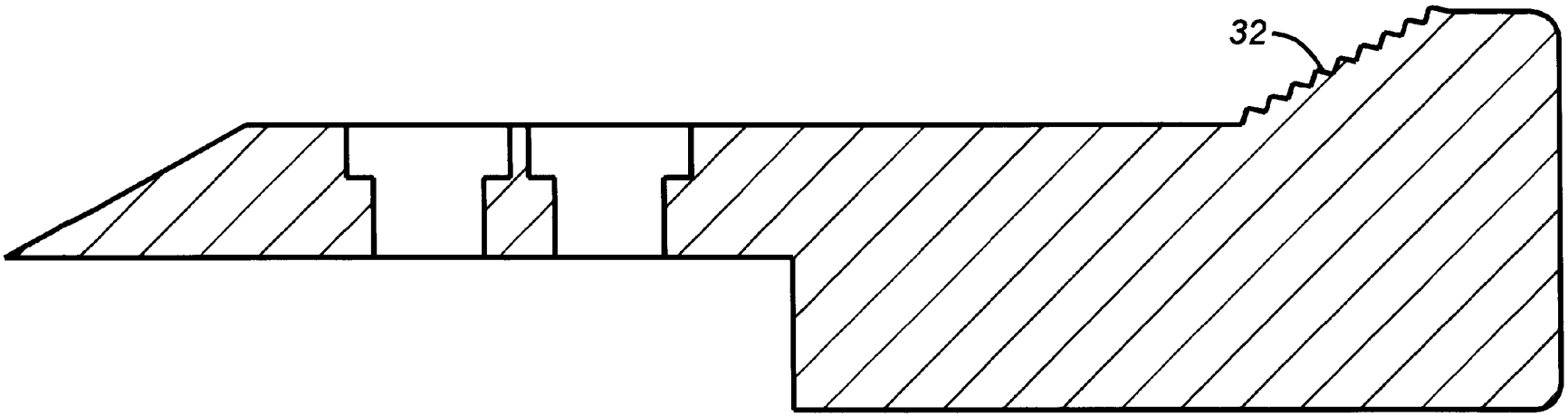
FIG. 4 is a detailed view of the latching lug.

The apparatus A has a body 20 on which is mounted an adjustable stop ring 22. A variety of known techniques can be used to adjust the stop ring 22 with respect to body 20. Inserting a pin through aligned openings is but one way. Stop ring 22 ultimately makes contact with top end shoulder 24 on the wellhead W. Also connected to body 20 is a hub 26 from which extend a plurality of finger-like arms 28. At the end of each of the arms 28 is a latching lug 30. Latching lug 30 is shown in more detail in FIG. 4. It has a series of circumferential serrations 32 which ultimately engage tapered surface 35, as illustrated in FIG. 3. Tapered surface 35 is directly below the internal shoulder within the wellhead W. A protector sleeve 34 extends from the hub 26 partly down arms 28. Those skilled in the art will appreciate that the lugs 30 are flexibly mounted at the ends of arms 28 and ride along the surface of wear bushing 18 if one is used. The use of the wear bushing 18 is optional, and the flexible nature of the mounting of the lugs 30 allows them to move over the surface of the seal bore 10 without any significant damage. As a precaution, however, it is preferred to insert the wear bushing 18 prior to advancing the apparatus A into the wellhead W.

Extending through the body 20 is a multi-component string 36. Illustrated at the lower end of string 36 in FIG. 1 is a thread 38 on which a mill of a known design is connected for cutting the casing (not shown) below the wellhead W. A non-rotating hub 40 is mounted over the string 36 and separated from its lower most illustrated sub 42 by a thrust bearing 44. Sub 42 rotates with the mill (not shown) as hub 40 remains stationary. In the run-in position, the hub 40 is separated from the lugs 30, although they are ultimately brought together as illustrated in FIG. 3. To maintain the distance between the lugs 30 and the hub 40, a J-slot assembly 46 is used to temporarily interconnect the string 36 to the body 20. Body 20 has an extension sub 48 which has within it a J-slot profile of a type well known in the art. The string 36 has a lug 50 which extends into the J-slot profile in the sub 48. In the position shown in FIG. 1, the string 36 is locked to the extension sub 48 so that they are advanced in tandem. The adjustable stop ring 22 is preset along the body 20 so as to allow the lugs 30 to advance beyond shoulder 12 when the stop ring 22 contacts the shoulder 24.

Figure 2:
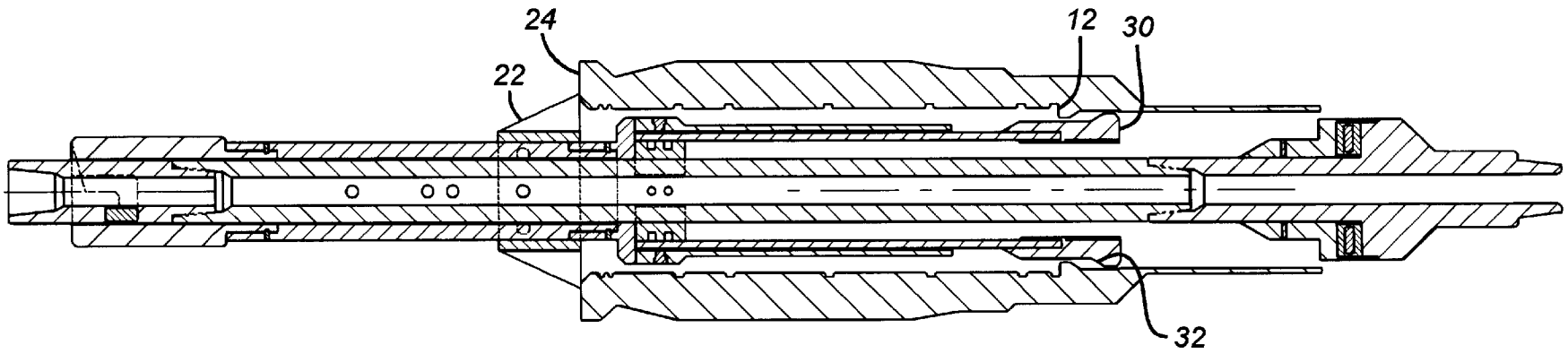
FIG. 2 is the view of FIG. 1, and showing the tool further inserted into the wellhead so that the latching lug is below the internal restriction.

The relationship between the placement of the stop ring 22 on the body 20 and the position of the lugs 30 beyond shoulder 12 as the stop ring 22 hits the shoulder 24 is best seen in FIG. 2. Those skilled in the art will appreciate that because of the flexible mounting of the lugs 30 on the arms 28, they merely jump over the shoulder 12 and get behind it as shown in FIG. 2.

FIG. 3 indicates the result of the pickup force after obtaining the position of FIG. 2. The stop ring 22 is pulled away from the shoulder 24 while the serrations 32 are on a tapered surface of the lugs 30 disposed at a comparable angle to the taper 35 so that they mate perfectly in response to an upward force.

The string 36 can be released from the extension sub 48 by the upward force which gets the lug 50 out of the J-slot groove (not shown) in the extension sub 48. When that occurs, the string 36, as shown in FIG. 3, is moved upwardly to bring the hub 40 into engagement with lugs 30. The string 36 can be rotated because bearing 44 permits the sub 42 to rotate with respect to the hub 40. An overpull is applied from the rig (not shown) through the string 36 so that the casing (not shown) being cut below the wellhead W is in tension during the cutting and/or milling operation. The nature of the cutting tool for severing the casing does not constitute a part of the claimed invention and any cutting or milling, or explosively actuated, tool known in the art that can meet the dimensional parameters of this particular application can be used, without departing from the spirit of the invention.

Similarly, the orientation of the serrations 32 can be varied without departing from the spirit of the invention. The serrations are meant to assist in resistance to applied torques transmitted to the lugs 30 through the bearing 44. If the bearing 44 is functioning properly, the applied torque to the lugs 30 should be insignificant.

Those skilled in the art can now appreciate the advantages of the apparatus A over prior devices for subsea wellhead retrieval. The first advantage is the adjustability of the stop ring 22 which does not enter the seal bore 10 but instead rests on the shoulder 24. Since there is a wide variety of dimensional relationships in the wellheads that are encountered, the adjustability of the stop ring 22 on the body 20 allows the apparatus A to be useful for any configuration of wellhead W, regardless of the distance between the shoulder 24 and the taper 35 on which the lugs 30 will ultimately become trapped. Another important is the fact that the J-slot assembly 46 is located above the stop ring 22 which means that when the cutting is going on fluid is being pumped down flow path 52 into the mill or cutter, while returns come up the annular space 54 and out the wellhead W between the lugs 30. In the past, the designs that have been used for wellhead retrieval have had their clutching mechanisms within the seal bore 10 of the wellhead W. By placing the clutching mechanism in this location as returns are being pumped back through seal bore 10, the clutching mechanism is prone to fouling and failure. If this occurs, it becomes extremely difficult to remove the apparatus from the wellhead W. Accordingly, the apparatus A of the present invention, by putting the clutching mechanism, which in the preferred embodiment is a J-slot assembly, outside the flow path of the circulating fluid with cuttings within seal bore 10 enhances the reliability of the operation.

By finding its initial support outside the seal bore 10 in combination with an adjustable stop ring 22, the apparatus A of the present invention can easily accommodate wellheads W that have a broad range of dimensions from their upper shoulder 24 to the internal shoulder 12 or taper 35. This is to be contrasted with some of the devices of the prior art which engage the thread 16. Such engagement presented a potential for damage to the seal bore 10 and a risk of a release of the grip during the cutting operation. Other designs that actually station the device on a shoulder internally, such as 12, have also been limited in their adaptability to grab a taper such as 35. They could also be damage to the seal bore upon insertion. The configuration and location of shoulder 12 and taper 35 in various wellheads W is not a uniform quantity. Thus, certain devices that have need to rest the apparatus on shoulder 12 in order to obtain a grip on taper 35 have had a limitation in that they have a fixed distance on the apparatus from the point where it lands on shoulder 12 to the point where the dogs extend further downhole so that they can be brought up for a locking engagement. For some applications, the physical configurations of the internal shoulder 12 and the taper 35 may exceed in depth the reach of the apparatus between its stop shoulder and its dog assembly.

Thus, the apparatus of the present invention allows cutting casing while subject to a tensile overpull of a desired quantity. The clutching mechanism is located outside of the wellhead so as to avoid fouling with cuttings in the return. Even if a riser pipe (not shown) is connected to the top of the wellhead W, the configuration of the J-slot assembly is more protected from the returning fluid with the cuttings than other types of clutching mechanisms used in the past, such as the Red Baron tools previously described, which are external and more exposed to contaminant buildup.

The foregoing disclosure and description of the invention are illustrative and explanatory thereof, and various changes in the size, shape and materials, as well as in the details of the illustrated construction, may be made without departing from the spirit of the invention.

What is claimed is:

1. A retrieval apparatus for a wellhead having an internal projection, a seal bore and a top shoulder comprising:

a body having a stationary and a rotatable component;

a locking mechanism at least in part on said stationary component; and a travel stop adjustably mounted on said stationary component to allow said locking mechanism to advance to a position to facilitate locking engagement with the internal projection on a wellhead.

2. The apparatus of claim 1 wherein:

said travel stop engages the top shoulder.

3. The apparatus of claim 1 wherein:

a releasable connection for said stationary and rotatable components located above said travel stop; and said travel stop engaging the top shoulder of the wellhead so as to place said releasable connection outside the seal bore of the wellhead.

4. The apparatus of claim 1 further comprising:

a serrated surface on said locking mechanism to secure its grip on the internal projection of the wellhead.

5. The apparatus of claim 1 further comprising:

a releasable connection between said stationary and rotatable components located outside the seal bore in the wellhead when said travel stop engages the top shoulder.

6. The apparatus of claim 5, further comprising:

a serrated surface on said locking mechanism to secure its grip on the internal projection of the wellhead.

7. The apparatus of claim 3, wherein:

said connection between said stationary and rotatable components comprises a J-slot mechanism.

8. The apparatus of claim 7, wherein:

said locking mechanism further comprises at least one flexibly mounted lug extending from said stationary component in a first position where it is unsupported and can flex past the internal projection and a second position where it is held against the internal projection.

9. The apparatus of claim 8, wherein:

said rotatable component comprising a support body offset from said lug when said J-slot mechanism connects said stationary and rotatable components, said support body movable to support said lug against the internal projection when said J-slot mechanism is disengaged.

10. The apparatus of claim 9, further comprising:

a thrust bearing supported on said rotatable component such that an upward force on said rotatable component forces said support body against said lug to hold said lug extending from said stationary component fixed against the internal projection while at the same time said rotatable component is free to rotate on said thrust bearing.

11. The apparatus of claim 10, further comprising:

a cutting apparatus mounted to said rotatable component to cut a tubular supporting the wellhead while the tubular is subjected to a tensile force from said support body acting on the internal projection through said lug.

12. The apparatus of claim 6, wherein:

said stationary body comprising a plurality of spaced apart openings; and said travel stop comprises at least one opening such that an object can be inserted into different aligned openings to secure said travel stop along said stationary component closer or further away from said locking mechanism.

13. The apparatus of claim 12, wherein:

said connection between said stationary and rotatable components comprises a J-slot mechanism.

14. The apparatus of claim 13, wherein:

said locking mechanism further comprises at least one flexibly mounted lug extending from said stationary component in a first position where it is unsupported and can flex past the internal projection and a second position where it is held against the internal projection.

15. The apparatus of claim 14, wherein:

said rotatable component comprising a support body offset from said lug when said J-slot mechanism connects said stationary and rotatable components, said support body movable to support said lug against the internal projection when said J-slot mechanism is disengaged.

16. The apparatus of claim 9, further comprising:

a thrust bearing supported on said rotatable component such that an upward force on said rotatable component forces said support body against said lug to hold said lug extending from said stationary component fixed against the internal projection while at the same time said rotatable component is free to rotate on said thrust bearing.

17. A retrieval apparatus for a wellhead having an internal projection, a seal bore and a top shoulder comprising:

a body having a stationary and a rotatable component;

a locking mechanism at least in part on said stationary component; and a travel stop adjustably mounted on said stationary component to allow said locking mechanism to advance to a position to facilitate locking engagement with the internal projection on a wellhead;

a wear bushing insertable into the seal bore prior to advancing said locking mechanism into the seal bore.

18. A retrieval apparatus for a wellhead having an internal projection, a seal bore and a top shoulder comprising:

a body having a stationary and a rotatable component;

a locking mechanism at least in part on said stationary component; and a travel stop adjustably mounted on said stationary component to allow said locking mechanism to advance to a position to facilitate locking engagement with the internal projection on a wellhead;

said travel stop engages the top shoulder;

a releasable connection between said stationary and rotatable components located outside the seal bore in the wellhead when said travel stop engages the top shoulder;

a wear bushing insertable into the seal bore prior to advancing said locking mechanism into the seal bore.

19. A retrieval apparatus for a wellhead having an internal projection, a seal bore and a top shoulder comprising:

a body having a stationary and a rotatable component;

a locking mechanism at least in part on said stationary component; and a travel stop adjustably mounted on said stationary component to allow said locking mechanism to advance to a position to facilitate locking engagement with the internal projection on a wellhead;

said travel stop engages the top shoulder;

said stationary body comprising a plurality of spaced apart openings; and said travel stop comprises at least one opening such that an object can be inserted into different aligned openings to secure said travel stop along said stationary component closer or further away from said locking mechanism.

* * * * *